US005146641A

United States Patent [19]

Zwickey

[11] Patent Number: 5,146,641

[45] Date of Patent: Sep. 15, 1992

[54] TRAUMA VICTIM HEAD IMMOBILIZATION DEVICE AND METHOD

[76] Inventor: Wayne C. Zwickey, 209 12th Ave. NE., Minneapolis, Minn. 55413

[21] Appl. No.: 656,405

[22] Filed: Feb. 15, 1991

[51] Int. Cl.[5] ..... A47C 70/02; A61G 13/00

[52] U.S. Cl. ..... 5/628; 5/622

[58] Field of Search ..... 269/328; 5/431, 434, 5/436, 437, 443

[56] References Cited

U.S. PATENT DOCUMENTS

| | | | |
|---|---|---|---|
| 4,165,125 | 8/1979 | Owen | 5/434 |
| 4,840,362 | 6/1989 | Bremer et al. | 269/328 |
| 4,850,068 | 7/1989 | Walpin et al. | 5/434 |
| 4,853,993 | 8/1989 | Walpin et al. | 5/431 |
| 4,924,541 | 5/1990 | Inagaki | 5/434 |

FOREIGN PATENT DOCUMENTS

| | | | |
|---|---|---|---|
| 2810864 | 9/1978 | Fed. Rep. of Germany | 269/328 |

*Primary Examiner*—J. J. Hartman

*Attorney, Agent, or Firm*—Lawrence M. Nawrocki

[57] ABSTRACT

An assembly for immobilizing the head of a trauma victim intended to be positioned on a stretcher board. The device includes a first sheet of flexible material which is to be mounted so that, when it is affixed to the board, a pair of normally-flaccid, open-sided loops are defined therein. The loops are intended to be at locations which straddle an intended location of the trauma victim's head. A pair of compressible blocks are also included. Each block is intended to be received within one of the normally-flaccid, open-sided loops. A block can be easily inserted into, and removed from, its corresponding loop because the loops are open-sided in nature. When the compressible blocks are received within the loops and constrained thereby, the blocks, together, define a seat in which the head of the trauma victim can be positioned.

10 Claims, 1 Drawing Sheet 10
12
14
16
17
18
20
21
22
24
26
28
30
32
34
36

TRAUMA VICTIM HEAD IMMOBILIZATION DEVICE AND METHOD

TECHNICAL FIELD

The present invention deals broadly with the field of transportation of trauma victims to a site for treatment. More specifically, however, the present invention deals with structures employed in moving victims of trauma, such as that which might result from an automobile accident, from the site of the accident to the hospital. The focus of the invention is apparatus for immobilizing a portion of the victim's anatomy during such transportation.

BACKGROUND OF THE INVENTION

Physical traumatization of individuals can occur in various ways. For example, trauma can be imposed intentionally during physical altercations, as a result of spousal or child abuse, etc. Traumatization can also result accidentally. The society in which we live is fast-paced, and, when one considers the plethora of automobiles on the roads of virtually every country of the world today, it is not difficult to recognize the volatile conditions which contribute to the numerous automobile accidents which result. Concerns about automobile accident trauma are borne up by statistics. Automobile accidents are one of the most common causes of death in today's society.

When physical trauma occurs as a result of either intentional or accidental circumstances, an ambulance is, typically, dispatched to the trauma location. Initial evaluation is performed as to the extent of injury and, frequently, a determination is made that it is appropriate to transport the victim to a hospital. Initial analysis will have resulted in the making of a preliminary diagnosis as to anatomical location and type of trauma experienced. In some cases, a relatively peremptory determination can be made that the injury is limited to a particular part of the victim. For example, it may be able to be quickly determined that, for example, an automobile crash victim has a broken leg and that the trauma is limited to the leg area. In such a case, the victim may be able to be transported to a hospital with only the leg immobilized.

In other cases, however, it may be determined that the person injured has experienced head, neck, or spinal injuries. In these cases it would almost be essential to totally immobilize the person for transportation. The same might be true if there were difficulty in evaluating the situation and there were any possibility that failure to totally immobilize the victim might result in additional injury.

If substantially total immobilization is necessary, an ambulance attendant would use a stretcher board on which the individual would be placed. Appropriate strap means would be employed to secure the victim to the board. Of particular concern is head and neck immobilization. Not only should the head and neck be immobilized in a direction longitudinally with respect to the stretcher board, but they should also be precluded from movement wherein the head turns to the left or to the right.

To accomplish these goals, the prior art has provided a structure which defined a seat in which the victim's head can be received. The seat comprises a cushion which includes two mounds, one disposable on either side of a location of which the victim's head would be positioned when strapped to the stretcher board. Such a head stabilizer is, typically, detachable from the stretcher board and is secured to the board by, for example, material identified under the trademark VELCRO. Such a stabilization device as known in the prior art is made by securing one lamina in an overlying relationship to a second lamina. It is intended that the laminae be flexible so that the structure can be folded for storage. One lamina is longer so that pockets can be defined for permanent receipt of cushion-type blocks therein. Blocks made, for example, of a high-density polyfoam material have been utilized for this purpose, and when used in the application, are permanently enclosed in pockets defined between the laminae. Ends of the pockets are closed so that the structure becomes an integrated assembly. With the blocks so enclosed and secured within the pockets, the blocks define the mounds between which the victim's head would be received. An appropriate strap could be secured across the chin and the eyebrows of the victim, ends of the strap being secured to the mounds, typically, by material marketed under the trademark VELCRO.

A frequent material used for manufacture of the laminae in which the pockets are defined is a washable vinyl. It is, of course, desirable that the material be able to be cleaned. If the trauma occurred as a result, for example, of an automobile accident, bodily fluids from the victim might impregnate the material if it were not able to be cleaned, and the material might become a fertile ground for bacterial growth.

The prior art does not, however, consider problems which arise as a result of employment of a high-density polyfoam material as the block inserts held within the pockets defined within the laminae. The vinyl laminae permanently enclose the block inserts within the pockets created, by stitching portions of fabric together. As a result, bodily fluids can seep through the stitched seams where segments of material are sewn together. Consequently, while the vinyl laminar covering might be cleaned and a user of the implement be lulled into a sense of security thinking that the implement has not permitted bacterial growth, such growth might actually be occurring in a rampant fashion within the block inserts. Certainly, this is an undesirable situation.

It is to these problems and dictates of the prior art that the present invention is directed. It is a trauma victim head immobilization apparatus which can be fully cleaned so that the likelihood of bacterial growth occurring is extremely minimal.

SUMMARY OF THE INVENTION

The present invention is a device for use in immobilizing the head and neck area of a trauma victim while he or she is positioned on a stretcher board. The device includes a first piece of flexible material and means for mounting the piece of flexible material to the stretcher board. The mounting is such that normally-flaccid, open-ended loops straddling an intended location of the trauma victim's head are defined in the piece of flexible material. The invention further includes a pair of compressible blocks. Each block is receivable within one of the loops so defined. Insertion and removal is accomplished through an open end of a loop within which a particular block can be received. When the blocks are received within their respective loops and constrained thereby, the blocks, together, define a seat in which the head of the trauma victim can be received.

In one embodiment of the invention, it is envisioned that the compressible blocks would be similarly sized and shaped. One type of block, it is entended, would be generally triangular in cross-section. In the preferred embodiment, each compressible block is made from a high-density polyfoam material.

In the preferred embodiment, the means by which the first piece of flexible material is mounted to the stretcher board to define the loops includes a second piece of flexible material. The second piece of material includes a first face for engaging the stretcher board, when the device is placed in position and a second, opposite face for mounting the first piece of flexible material thereto. In such an assembly, when the second piece of flexible material is stretched into a planar configuration, the loop in the first piece of material would be defined as a result of the locations of affixation of the first piece of material to the second piece of material.

In an embodiment wherein the loops are created by mounting the first piece of material to the second, means can be employed to attach the assembly of the two pieces to the stretcher board so that the loops straddle an intended location of the trauma victim's head. One appropriate manner of accomplishing this is to provide an underside of the second piece of material with patches of hook and/or pile VELCRO material. Pads of complementary material could be provided at appropriate locations on the stretcher board in order to effect affixation of the device to the board.

The construction of a device employing two laminae would, typically, have two pieces of material which are substantially rectangular in shape. The pieces would have substantially the same width, but the length of the first piece would be longer, so that, when edges of the first piece are aligned with edges of the second piece and the first piece secured to the second piece, the normally-flaccid, open-ended loops would be defined and made available.

In this embodiment, the invention contemplates affixation or mounting of the first piece of material to the second piece by stitching along elongated sides of the laminae. If desired, the loops could be more definitively established by stitching across the pieces of material in a direction generally transverse to the longitudinal axis of the laminae assembly.

It has been determined that various materials are appropriate for use in the manufacture of the first and second pieces of flexible material. Certainly, washable vinyl, as known in the prior art, could be used. Commercial-grade polytubing and commercial-grade, plastic-coated mesh are deemed to be appropriate also.

The invention also contemplates a method. The method invention includes steps for manufacturing an implement for immobilizing the head of a trauma victim positioned on a stretcher board. Those steps include providing a first piece of flexible material, generally-rectangular in shape, as previously defined. A second, generally-rectangular piece of flexible material, also as previously defined, is additionally included. Edges of the two laminae are aligned, as are sides, and, with the first piece of material in such an overlying disposition, the two pieces are secured together. Since the length of the first piece of material is greater than that of the second, however, the loops as in the apparatus invention, will be defined. It is assumed, of course, that, prior to affixing the first lamina to the second, the second would be stretched into a generally planar configuration.

A pair of compressible blocks are also provided. Each block is shaped and sized so that it can be easily inserted into, and removed from, a corresponding loop defined in the first piece of material. Each block has a surface so that when the blocks are inserted into corresponding loops, the surfaces of the blocks, together, define the seat in which the head of the trauma victim can be received.

The present invention is thus an improved apparatus and method for provision of a head immobilization device for use with a stretcher board. More specific features and advantages obtained in view of those features will become apparent with reference to the DETAILED DESCRIPTION OF THE INVENTION, appended claims, and accompanying drawing figures.

DETAILED DESCRIPTION OF THE INVENTION

Figures 1, 2, 3, 4:
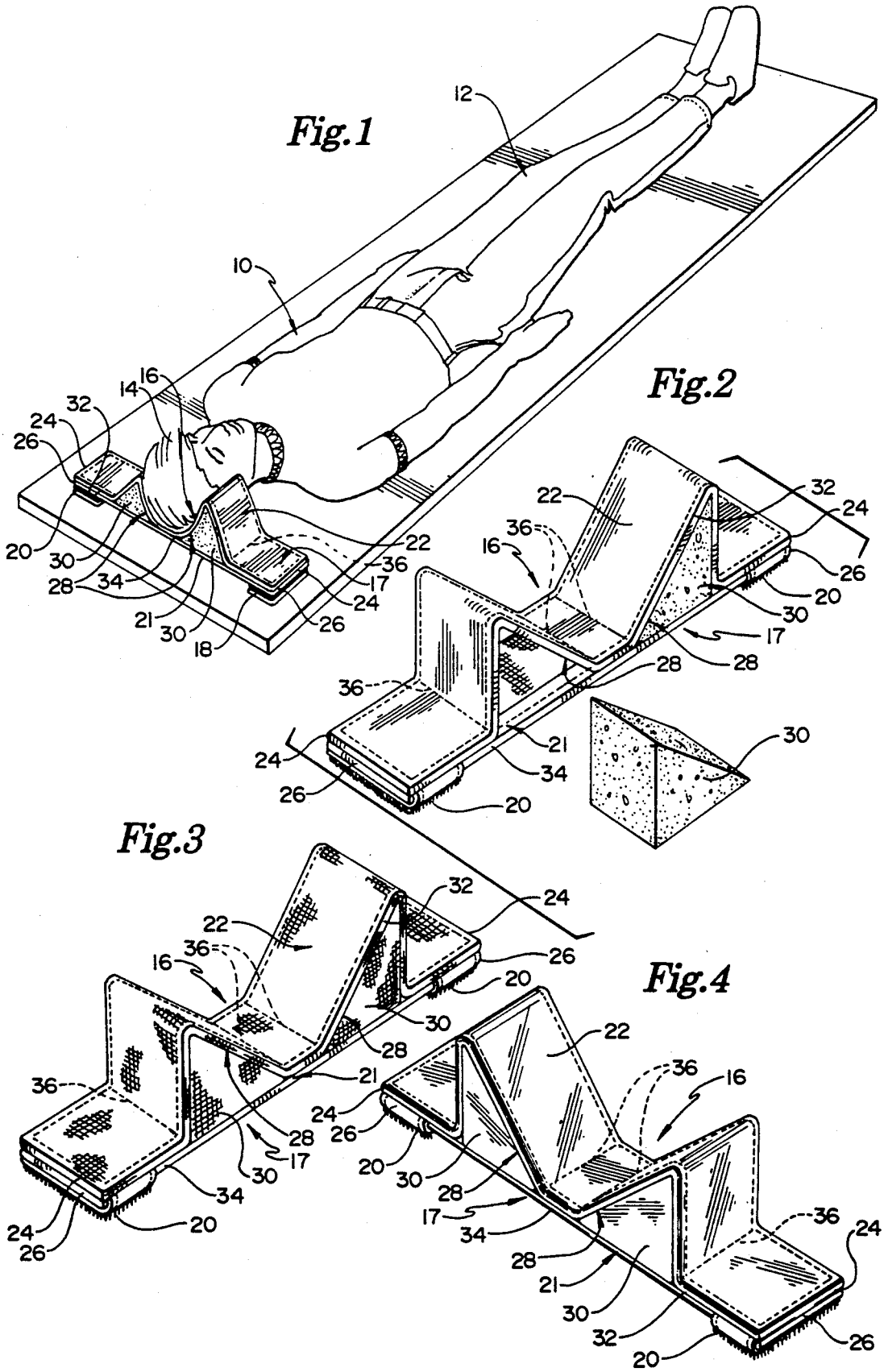
FIG. 1 is a perspective view of the invention shown in use with a stretcher board having a trauma victim thereon.
FIG. 2 is an exploded perspective view showing the present invention with a compressible block insert removed from an intended position within one of two defined loops.
FIG. 3 is a perspective view, similar to FIG. 2, showing both block inserts received in loops defined by laminae formed from a plastic-coated mesh material.
FIG. 4 is another perspective view of the structure in accordance with the present invention showing a structure wherein the whole assembly is disposable.

Referring now to the drawing, wherein like reference numerals denote like elements throughout several views, FIG. 1 illustrates a structure embodying the present invention as in use with a stretcher board 10. Such stretcher boards 10 are known in the prior art and are used for transportion of trauma victims.

FIG. 1 illustrates a trauma victim 12 reclining on the board 10 with his head 14 received in a seat 16 define by the structure embodying the present invention. The device 17 is attached to the stretcher board 10 by means of "hook-and-pile" pile pads 18 positioned at appropriate locations on the stretcher board 10 and "hook-and-pile" hook patches 20 secured to an undersurface of a lower lamina 21 of the device 17. When the flexible device 17 is stretched out, the patches 20 on the device 17 and corresponding pads 18 on the stretcher board 10 are engagable to effect affixation.

FIG. 2 illustrates a device 17 in accordance with the present invention that is made, in large part, from a flexible vinyl material. The device 17 includes a first, or upper, piece 22 of flexible material, and a second, or lower, piece 21 of flexible material. Both of these two pieces 21, 22 of material are made from the washable vinyl.

As seen in FIG. 2, both pieces of vinyl material are cut in rectangular shapes. Both pieces 21, 22 are provided with similar widths, although the first, or upper, piece 22 is afforded a greater length. As a result, when edges 24 of the upper piece 22 are aligned with corresponding edges 26 of the lower piece 21, in view of the excess material in the upper piece 22, loops 28 will be able to be formed. The difference in length between the two pieces 21, 22 is made to be such that the loops 28 that will be formed will be of a size so as to tightly accommodate compressible block inserts 30 which can be fitted into respective loops 28. The size of the inserts 30 is dictated by the desired height of mounds between which a trauma victim's head 14 is to be received.

As seen in FIG. 2, the overlying sides 32, 34 and edges 24, 26 of the two pieces 21, 22 of material are stitched to maintain them as a unitary assembly. The edges 24, 26, spaced longitudinally from one another, are aligned, as are the lateral sides 32, 34.

It will be understood, of course, that the loops 28 are not stitched down to the lower lamina 21. In view of the fact, however, that closure swatches are not secured in place closing the open ends of the loops 28, manufacture is significantly easier and less expensive than is true of structures in the prior art wherein ends of the loops 28 are closed.

FIG. 2 illustrates stitching, as previously discussed, along the edges 24, 26 and along the sides 32, 34 of the overlying laminae 21, 22. Additionally, however, stitching (as at 36) is shown at the base of each loop 28 along both sides thereof. That stitching 36 is substantially transverse to the longitudinal axis of the structure. The loops 28 are, thereby, more definitively established.

FIG. 2 also illustrates a "hook-and-pile" hook material patch 20 at either end of the laminae assembly. These patches 20 are shown as being mounted to an undersurface of the lower lamina 21 wherein they can be engaged and held to corresponding pads 18 mounted on the stretcher board.

A pair of compressible insert blocks 30 are shown in FIG. 2. One is shown as being received within one of the loops 28, and the other in shown in position external to its corresponding loop 28. While FIG. 2 illustrates the loop 28 not having a compressible block 30 received therein has having substantially the same shape as the block 30 intended to be inserted, it will be understood that the loop 28 is normally flaccid and that the triangular shape is merely for the purpose of reflecting that the block 30, external to the loop 28, is intended to be inserted thereinto.

FIG. 2 shows the blocks 30 as being generally triangular in cross-section. It will be understood that this is not an exclusive configuration. Rather, while such a configuration might be optimal to define a seat 16 for receipt of a trauma victim's head 14, other embodiments are envisioned. The blocks 30 merely need be of a shape so that accommodating surfaces will be defined for receipt of the victim's head 14.

An intended material of which the blocks 30 can be formed is high-density polyfoam. Such a material renders a block 30 formed therefrom so that a measure of comfort is afforded to the victim 12. At the same time, however, it provides enough rigidity so that the seat 16 defined by the blocks 30 will have sufficient form to accomplish its intended goal. Materials other than a high-density polyfoam are specifically contemplated as being able to be used in the invention.

If desired, VELCRO-like bands (not shown) could be provided on the outer surfaces of the loops 28. Straps (not shown), having compatible hook-and-pile material at distal ends thereof could then be secured across the victim's chin and eyebrows in order to effect immobilization. Any appropriate strap securing means could, however, could be employed for this purpose.

As previously discussed in this document, a structure such as that in accordance with the present invention is intended to be used in immobilizing the head and neck of a trauma victim 12 when the victim 12 is positioned in place on a stretcher board 10. Typically, such victims have incurred lacerations and may manifest severe bleeding. The victim's blood would, of course, contaminate the compressible blocks 30. The ends of the loops 28 are open, and blood would be free to seep through the open ends into the blocks 30. This would, of course, be true also in structures of the prior art, since blood would be free to seep through the seams of the structure. With a structure in accordance with the present invention, however, the blocks 30, when use of the apparatus 17 is terminated can be disposed of. Since the vinyl assembly illustrated in FIG. 2 is washable, it could be rinsed off after the blocks 30 were disposed of and be stored until the next time its use became necessary. If desired, new blocks 30 could be inserted into the loops 28 pending the need for the apparatus 17, but the blocks 30 could also be maintained in envelopes (not shown) keeping them in a sterile environment. When the implement 17 is needed in the future, blocks 30 could be easily inserted into the loops 28 for use.

FIG. 3 illustrates a structure substantially identical to that of FIG. 2. The structure in FIG. 3, however, employs laminae 21, 22 which are made from a commercial-grade, plastic-coated mesh. Otherwise all discussion with respect to FIG. 2 applies to FIG. 3 also, including the disposability of the compressible blocks 30.

The same applies to FIG. 4. In FIG. 4, however, the laminae 21, 22 illustrated are made from a commercial-grade polytubing. Since such material is quite inexpensive, the whole apparatus could be disposed of after use.

Numerous characteristics and advantages of the invention have been set forth in the foregoing description. It will be understood, of course, that this disclosure is, in many respects, only illustrative. Changes can be made in details, particularly in matters of shape, size, and arrangement of parts without exceeding the scope of the invention. The invention's scope is defined in the language in which the appended claims are expressed.

What is claimed is:

1. Apparatus for immobilizing the head of a trauma victim positioned on a stretcher board, comprising:

(a) a first sheet of flexible material;

(b) a second sheet of flexible material having a first face for engaging the stretcher board and a second, opposite face for mounting said first sheet of flexible material when said second sheet of flexible materials is stretched into a planar configuration;

(c) means for mounting said first sheet of flexible material to the second sheet of flexible material such that a pair of normally flaccid, open-sided loops with open sides are defined in said first sheet of flexible material, wherein said pair of open-sided loops straddle an intended location of the trauma victim's head;

(d) a pair of compressible blocks, each receivable within one of said loops through one of said open sides thereof to be constrained by its respective loop in a manner wherein one of said blocks, in combination with the other of said blocks, defines a seat in which the head of the trauma victim can be received; and (f) means for attaching an assembly of said first sheet of flexible material, said second sheet of flexible material, and said compressible blocks to the stretcher board.

2. Apparatus in accordance with claim 1 wherein each compressible block is similarly sized and shaped, and wherein each compressible block is triangular in cross-section.

3. Apparatus in accordance with claim 2 wherein each compressible block is made from a high-density polyfoam material.

4. Apparatus in accordance with claim 1 wherein said first sheet of flexible material and said second sheet of flexible material are substantially rectangular in shape, said first and second sheets of flexible material having substantially the same width, but wherein said first sheet of flexible material has a length greater than a length of said second sheet of flexible material.

5. Apparatus in accordance with claim 4 wherein said first sheet of flexible material is stitched to said second sheet of flexible material along elongated sides thereof to define said pair of flaccid, open-sided loops.

6. Apparatus in accordance with claim 5 wherein said first sheet of flexible material is stitched to said second sheet of flexible material along axes generally transverse to longitudinal axes of said sheets of flexible material at bases of said loops in order to further define said pair of normally-flaccid, open-sided loops.

7. Apparatus in accordance with claim 1 wherein the stretcher board has provided thereon one or more pads made of one of hook and pile material, and wherein said first face of said second sheet of flexible material has, provided thereon, patches, each made of one of hook and pile material such that, when an assembly of said first and said second sheets of flexible material is positioned in an intended location on the stretcher board wherein said seat in which the head of the trauma victim can be received is appropriately positioned, said patches will overlie reciprocal material pads on the stretcher board.

8. Apparatus in accordance with claim 1 wherein said first and second sheets of flexible material are made from washable vinyl.

9. Apparatus in accordance with claim 1 wherein said first and second sheets of flexible material are made from a commercial-grade polytubing.

10. Apparatus in accordance with claim 1 wherein said first and second sheets of flexible material are made from a commercial-grade, plastic-coated mesh.

* * * * *